United States Patent [19]

Schaefer

[11] Patent Number: 4,545,534

[45] Date of Patent: Oct. 8, 1985

[54] AIR BRUSH ORGANIZER

[76] Inventor: Gerald O. Schaefer, Shorewood Dr., Madison Lake, Minn. 56062

[21] Appl. No.: 521,138

[22] Filed: Aug. 8, 1983

[51] Int. Cl.[4] ..... B05B 9/02

[52] U.S. Cl. ..... 239/286; 239/307; 211/78; 118/500

[58] Field of Search ..... 222/132, 144, 23; 211/77, 78, 205, 131, 163; 118/500; 239/304, 305, 307, 286, 289, 300, 346; 434/103, 104

[56] References Cited

U.S. PATENT DOCUMENTS

| | | | |
|---|---|---|---|
| 547,552 | 10/1895 | Keegan | 211/131 |
| 2,193,597 | 3/1940 | Knopf . | |
| 2,196,397 | 4/1940 | McDonald | 434/104 |
| 3,452,880 | 7/1969 | Kovacik et al. | 211/131 |
| 3,805,965 | 4/1974 | Champagne . | |
| 3,949,902 | 4/1976 | Thompson . | |
| 4,171,097 | 10/1979 | Rebold | 239/346 |
| 4,249,318 | 2/1981 | Anderson et al. | 211/78 |
| 4,330,088 | 5/1982 | Koyama et al. | 239/308 |

FOREIGN PATENT DOCUMENTS

| | | | |
|---|---|---|---|
| 810328 | 3/1937 | France | 239/346 |

*Primary Examiner*—H. Grant Skaggs

*Attorney, Agent, or Firm*—Burd, Bartz & Gutenkauf

[57] ABSTRACT

An air brush organizer for helping an artist maintain his air brushes in an orderly fashion. The air brush organizer comprises a housing supported on a vertical standard which in turn is supported by a base. A manifold within the housing is adapted for connection to a source of air under pressure and to each of the air guns. The top wall of the housing forms a recessed shelf which receives and holds a plurality of air guns. A plurality of spaced openings in the housing top wall permits passage of a length of flexible hose or tubing extending from the air manifold to each air gun. A test pattern easel is mounted on the standard above the housing. A vertical socket at the top end of the housing receives various work supporting accessories and mountings to hold the artist's work conveniently accessible for painting with the air guns. An optional air brush support may be mounted above the top of the housing top wall where additional colors are needed. Optionally a color coding band is applied around the housing top wall, the colors corresponding to the location of the air brushes for applying those particular colors. The usual jumble and clutter of an artist's work bench is avoided. Greater time efficiency is attained because of the in-line orientation of air brush, test easel and work which is achieved by use of the air brush organizer.

16 Claims, 13 Drawing Figures

FIG. 6
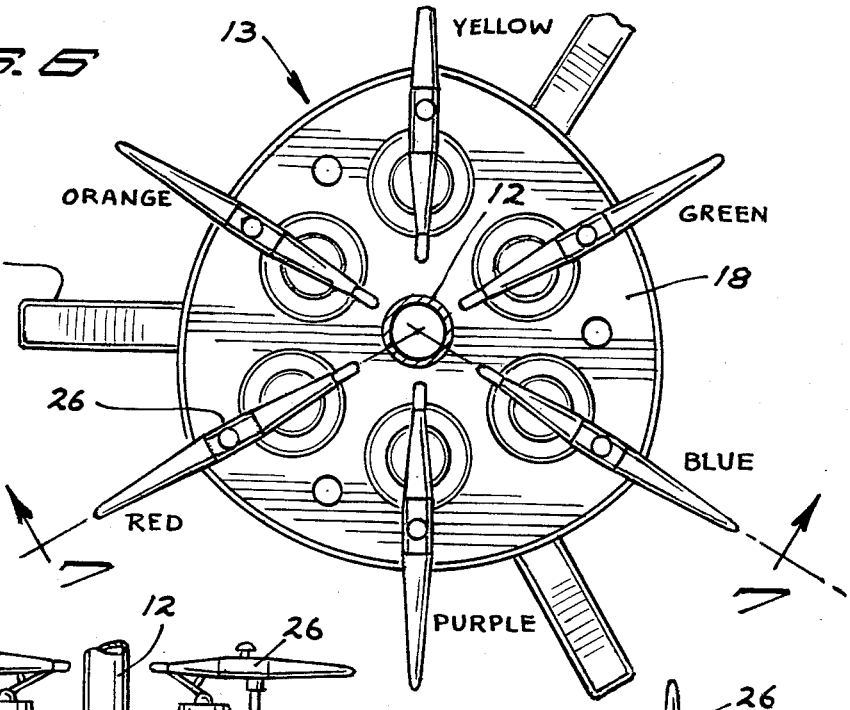
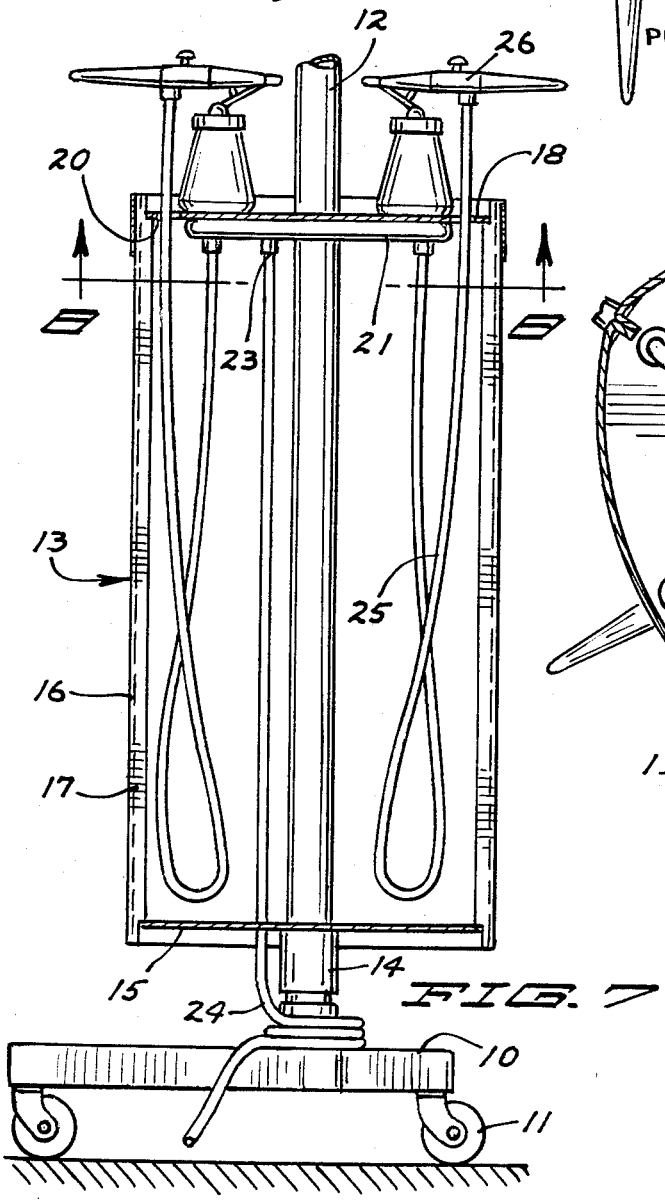
FIG. 7
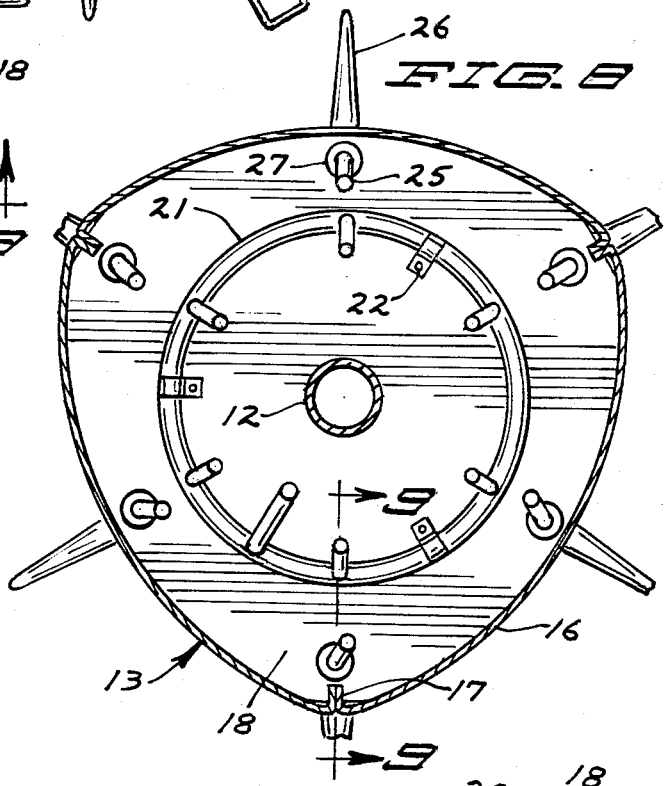
FIG. 8
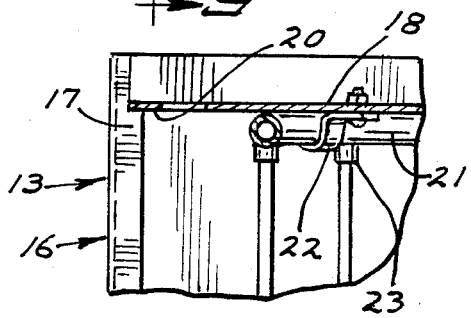
FIG. 9

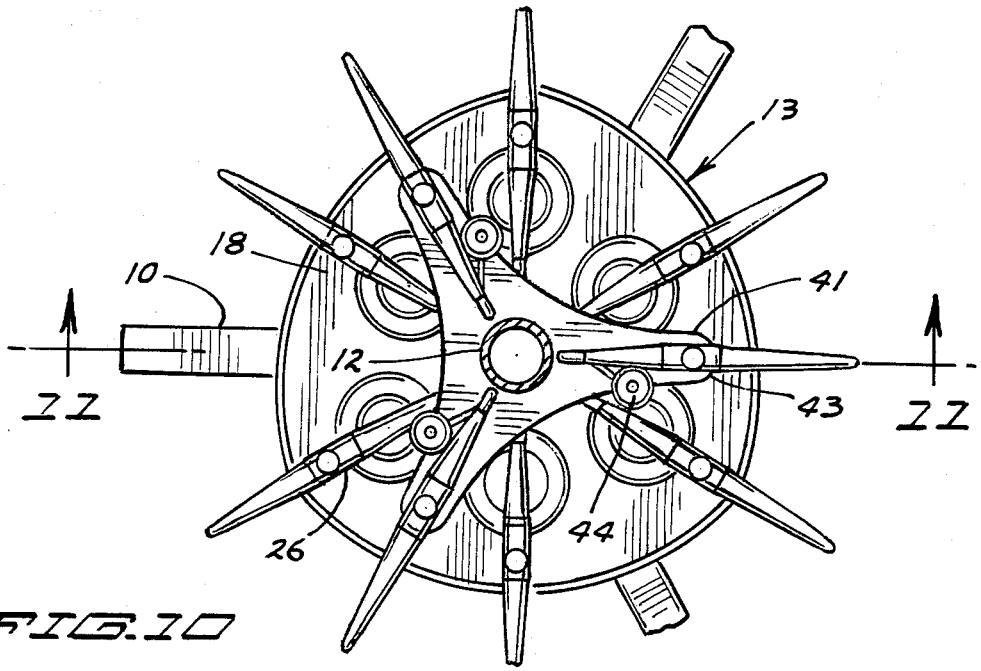
FIG. 10
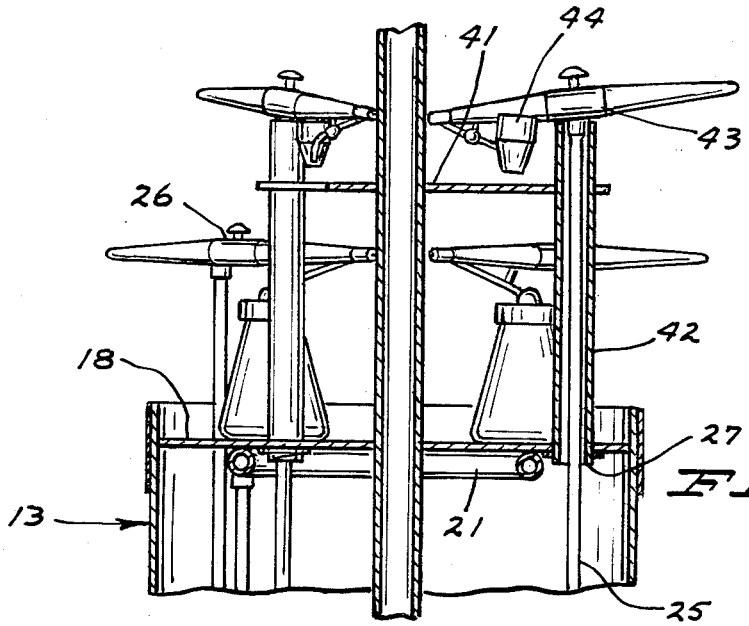
FIG. 11
FIG. 12
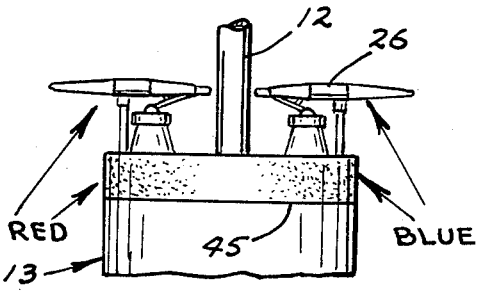
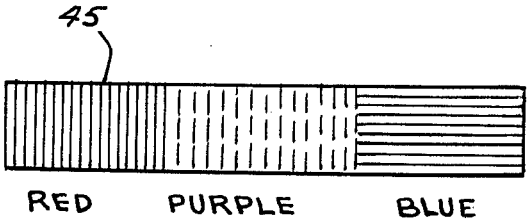
FIG. 13

AIR BRUSH ORGANIZER

BACKGROUND OF THE INVENTION

1. Field of the Invention

This invention relates to a rack or stand for holding in an organized manner air brushes used by artists in various art forms including illustration, taxidermy, and the like. The invention is intended to bring order out of the chaos usually present in an air brush artist's studio where the implements are kept in a clutter of hoses and air brushes on a work bench, where there is little or no room to place a test sheet and the equipment crowds the work being done. The device of the present invention permits the artist to remain in one position. He may rotate the various elements to bring the air brush of proper color to him, rather than going after the air brush. A test sheet is immediately at hand. Everything is readily accessible to the object on which the artist is working.

2. The Prior Art

None of the prior art patents of which applicant is aware is particularly pertinent. Champagne U.S. Pat. No. 3,805,965 is directed to a workshop storage unit which bears a superficial resemblance to the air brush organizer. However, there are substantial structural and functional differences by which the present structure distinguishes over that of the patent. Knopf U.S. Pat. No. 2,193,597 shows a means of supporting a work piece to be painted in connection with structure for holding and storing the coloring materials. However, this patent is of only incidental interest. Thompson U.S. Pat. No. 3,949,902 is of lesser pertinence. It shows a number of liquid dispensing units connected by flexible tubing to reservoirs for those liquids, all stored within a portable housing.

SUMMARY OF THE INVENTION

Broadly stated, the air brush organizer according to the present invention is directed to an assembly for maintaining artists' air brushes in an orderly manner. It includes a vertical standard, a base for supporting that standard on a floor, and a housing supported on the standard spaced upwardly above the base. The housing encloses a manifold which is adapted for connection to a source of air under pressure. The top wall of the housing is in the form of a recessed shelf for holding a plurality of air guns. That top wall has a plurality of spaced openings, each for passage of a length of flexible tubing extending from the manifold to an air gun. The standard extends above the top of the housing. A test pattern easel is mounted thereon and the top of the standard includes a vertical socket into which one of a plurality of work supporting accessories may be placed for holding works of various types on which the artist may be working. The base is preferably fitted with wheels or casters for easy mobility. The housing is preferably rotatably supported on the standard. The test pattern easel is preferably rotatably mounted on the standard. The various work supporting accessories are rotatably received in the socket at the top of the standard.

BRIEF DESCRIPTION OF THE DRAWINGS

The invention is illustrated by the accompanying drawings in which corresponding parts are identified by the same numerals and in which:

FIG. 6 is a horizontal section on a slightly enlarged scale on the line 6—6 of FIG. 1 and in the direction of the arrows showing primarily the top of the housing;

FIG. 7 is a vertical section on the line 7—7 of FIG. 6 and in the direction of the arrows;

FIG. 8 is a vertical section on the line 8—8 of FIG. 7 and in the direction of the arrows;

FIG. 9 is a fragmentary vertical section on a slightly enlarged scale on the line 9—9 of FIG. 8.

FIG. 10 is a horizontal section similar to FIG. 6 but showing an additional optional tertiary color air brush holder mounted above the top of the housing;

FIG. 11 is a vertical section on the line 11—11 of FIG. 10 and in the direction of the arrows;

FIG. 12 is a fragmentary elevation of the top of the housing showing an optional color coding system; and FIG. 13 is an elevation of the color coding band on an enlarged scale.

DETAILED DESCRIPTION OF THE PREFERRED EMBODIMENT

Figure 1:
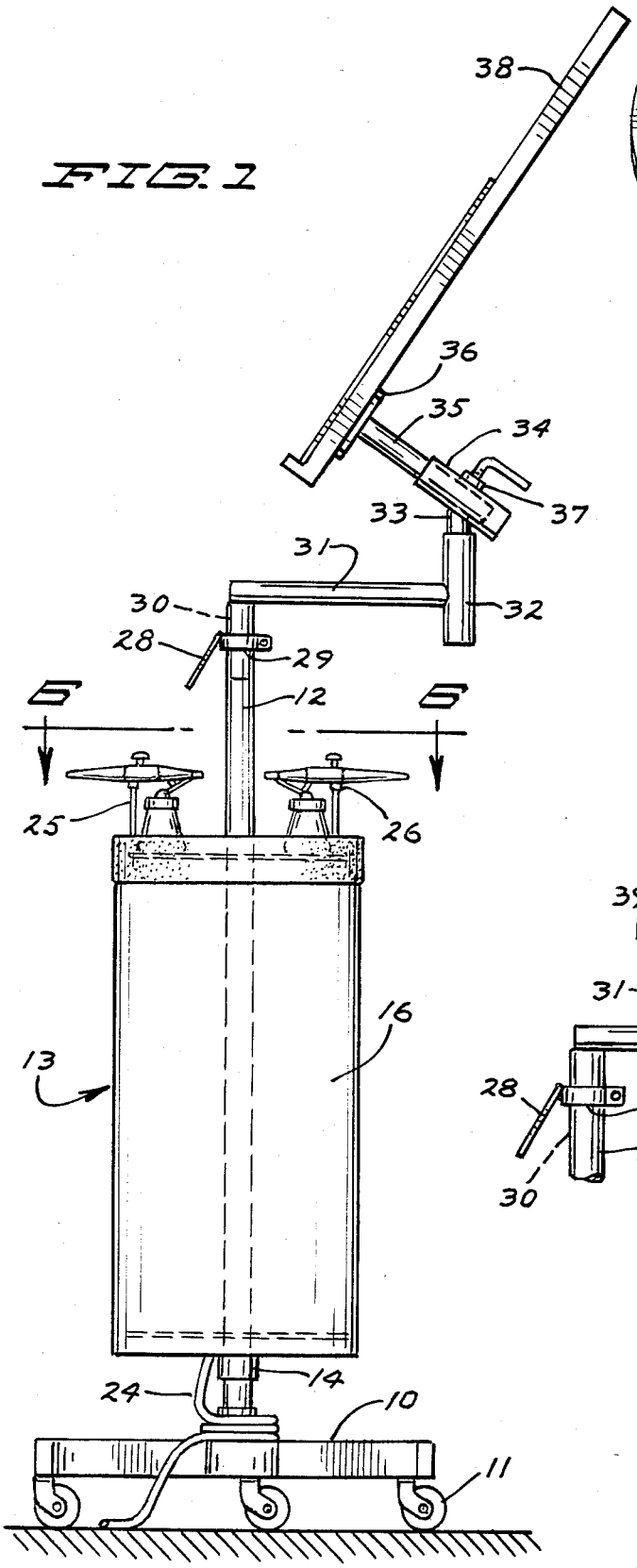
FIG. 1 is an elevation of the air brush organizer according to the present invention.

Referring now to the drawings, and particularly to FIGS. 1 and 7, the air brush organizer according to the present invention comprises a base 10 adapted for support on a floor and preferably provided with wheels or casters 11 for easy mobility. A housing, indicated generally at 13, is rotatably supported on standard 12 as by means of a suitable bearing 14 supporting the housing bottom wall 15.

Although the housing may be rectangular or circular in cross section, preferably it is generally triangular as illustrated, with arcuate elliptical walls. Each of the arcuate wall panels 16 has an inwardly extending flange or lip 17 along its vertical edges. Each abutting pair of flanges 17 of adjacent wall panels 16 are received and snap into radial slots in the bottom wall 15 of the housing and the top wall 18. The bottom end of each flange is cut away to provide a shoulder 19 which rests upon bottom wall 15. The top edge of each flange is cut away to provide a shoulder 20 upon which top wall 18 is supported (FIG. 9).

A manifold 21, here shown as circular in form (FIG. 8), is secured by means of a plurality of clips 22 to the bottom side of housing top wall 18. The manifold is provided with a plurality of fittings 23 for connection of flexible hose or tubing. Hose or tubing 24 connects the manifold to an air compressor or other source of gas under pressure. A plurality of hoses or tubes 25 connect the manifold to a corresponding plurality of air guns 26. Each hose or tubing 25 extends through one of a plurality of spaced openings 27 in the housing top wall 18.

The upper edges of the housing wall panels 16 extend above the surface of the top wall 18 to provide a recessed shelf which holds a plurality of air guns 26 supported by their paint receptacles spaced around the top shelf for easy access. As seen in FIG. 7, each hose or tubing 25 is of substantial length to permit free maneuvering of the air gun by the artist simply by withdrawing whatever hose is necessary through the top openings 27. When the air gun is replaced on the shelf, the excess tubing drops through the top opening and is stored in a neat orderly manner within the housing 13.

A test pattern easel 28 (FIGS. 1–4) is mounted by means of a fitting 29 on the standard 12 spaced above the top of the housing. Easel 28 extends angularly outwardly and downwardly from the standard for easy access by the artist so as to permit testing of each air gun before use. Fitting 29 preferably includes a bearing journalling the fitting and easel for rotation for easy access of the easel to the artist.

The top of standard 12 functions as a vertical socket for receiving various work supporting accessories. One form of accessory is an extension arm made up of several pipe segments including a vertical component or shank 30 which fits into the socket at the top of standard 12, a horizontal component 31, and a further vertical component 32 which in turn functions as a socket for receiving other work supporting accessories. The extension arm is freely rotatable to the standard.

Figure 2:
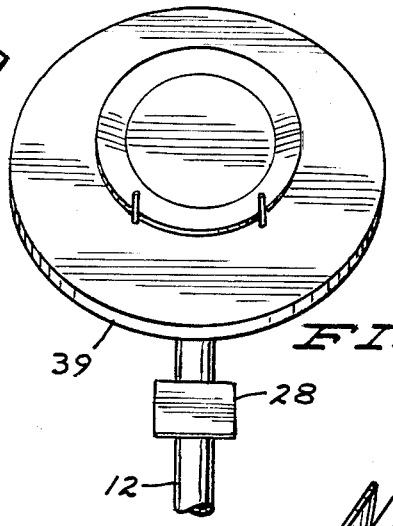
FIGS. 2 through 5 illustrate various work supporting accessories which may be mounted on the air brush organizer.
Figure 3:
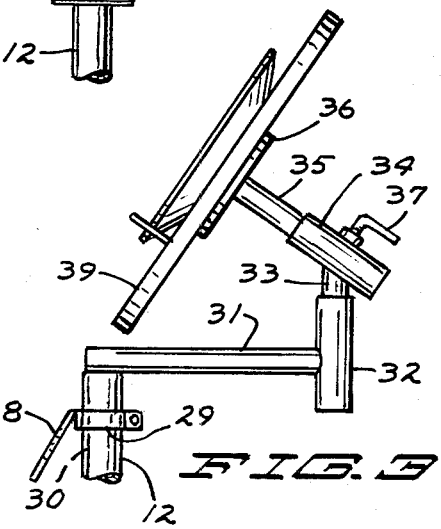
Figure 4:
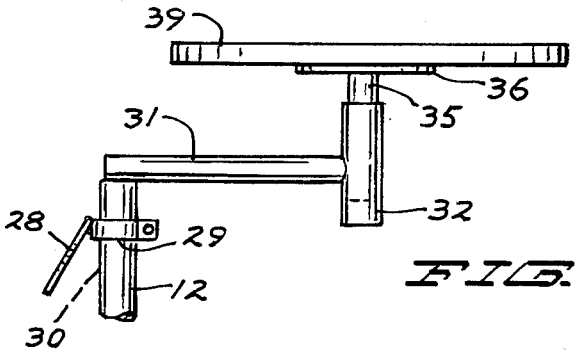
Figure 5:
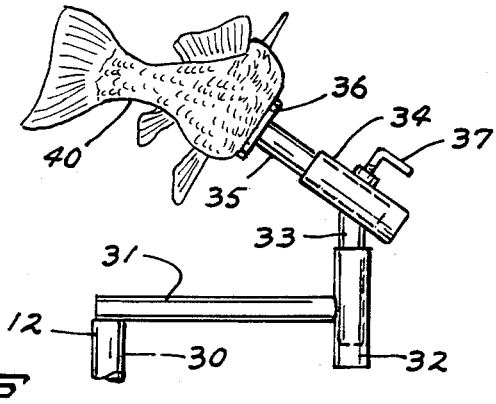

One form of adapter includes a vertical component or shank 33 which may be received into the socket 32 and which supports an angularly disposed socket member 34 which in turn functions as a socket for receiving the shank 35 of a mounting plate 36. Clamping means 37 may be provided to permit adjustment of the position of shank 35 in socket 34. The mounting plate may support a standard easel, easel 38 for exmple, as shown in FIG. 1. Alternatively, it may support a circular table element 39, adapted for holding a piece of china to be painted as shown in FIGS. 2 and 3, or the mounting plate may support a taxidermy specimen 40 as shown in FIG. 5. Or, as seen in FIG. 4, the table element 39 may be used flat by inserting the shank of the mounting plate 36 directly in the socket 32 of the extension arm. The vertical shank 33 of the angular adapter or the shank 35 of the mounting plate 36 may be inserted directly into the socket at the top of the standard. The air brush organizer can readily be adapted to any of a vast number of situations which might be faced by the artist in performing his work.

For most purposes the air brush artist needs six or more air brushes in the three primary and three secondary colors, black, white, trinary colors, primers, sealers, etc. Referring to FIGS. 10 and 11, there is shown a support for additional air brushes in the form of a generally triangular spider-like platform 41 supported above housing top wall 18 by means of tubular legs 42 which extend above the top surface of platform 41. The shelf or platform 41 is secured for rotation with the housing and supports air brushes 43 on its projecting arms. These arms are disposed to lie generally between a pair of adjacent air guns 26 supported on the housing top shelf below and the platform is spaced high enough above the housing to permit easy removal of the lower air brushes. Each of legs 42 overlies an opening 27 in the housing top wall and extends through a corresponding opening in the end of each arm of shelf 41. The air brushes 43 as illustrated are of the type having a relatively small paint containing cup 44, as compared with the larger paint containing jars of the air brushes 26. As a result of the smaller cups 44, the air guns 43 are difficult to support in an upright position. This is accomplished in part by means of air hoses 25 extending through hollow legs 42 to lend support to the air gun resting on the top of the leg extension. At the same time, the air gun 43 is easily accessible and removable for use by the artist. Air guns, such as those shown at 26, with larger paint jars, may also be supported on the upper platform 41 where this is desired.

In its preferred form, the cross section of housing 13 is an elliptical triangle. For easy location by the artist, the air brushes 26 whose paint containers hold the primary colors are located at the corners or apices of the housing top wall, with the air brushes of the corresponding secondary colors located between the primary colors. As seen in FIGS. 12 and 13, a color coding band 45 is desirably applied to the top edge of the housing wall. As shown, the band 45 is red at one end, blue at the other, and purple in between. The air brush for applying red paint is located adjacent the red portion of the band and the air brush for applying blue color adjacent to the blue portion. The air brush for applying purple, the secondary color formed from admixture of red and blue, is positioned between the red and blue air brushes adjacent the purple portion of the color band. Proceeding around the housing in a clockwise direction, the portion of the next panel, which is not visible, would be red, orange and yellow, in order, and the band on the last panel would be yellow, green and blue, in order. On larger units, as many as twelve air brushes in primary, secondary and trinary colors may be supported on top wall shelf 18 with other colors, sealers, primers, etc. on the auxiliary shelf 41. Where such additional trinary colors are used, the color band may additionally include those colors adjacent to the air brush of the same color for easy identification of that air brush. For example, yellow orange results when yellow and orange are mixed. The air brush for applying yellow orange is located between those for applying yellow and orange and the location is identified on the color band.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. An air brush organizer, for maintaining artists' air brushes in an orderly manner, which comprises:

(A) a vertical standard, (B) a base for said standard, (C) a housing supported on said standard spaced from the base, said standard extending above the top of the housing, (D) a manifold within the housing, said manifold adapted for connection to a source of air under pressure, (E) a recessed shelf, forming the top wall of the housing, for receiving and holding a plurality of air guns, (F) a plurality of spaced openings in said housing top wall, each for passage of a length of flexible tubing extending from said manifold to an air gun, (G) a test pattern easel mounted on said standard above the housing, and (H) a vertical socket at the top end of said standard for receiving adaptive work-supporting accessories.

2. An air brush organizer according to claim 1 wherein said housing is supported on a bearing for rotation about the standard.

3. An air brush organizer according to claim 1 wherein said manifold is supported from the inside top wall of said housing.

4. An air brush organizer according to claim 3 wherein said manifold is circular in configuration and concentrically disposed about the standard.

5. An air brush organizer according to claim 4 wherein said manifold has a plurality of tubing fittings corresponding in number to the spaced openings in the housing top wall and located adjacent thereto.

6. An air brush organizer according to claim 1 wherein said test pattern easel extends angularly downwardly and outwardly from said standard, said easel being rotatably mounted relative to said standard.

7. An air brush organizer according to claim 1 wherein:

(A) the vertical walls of said housing are arcuate, (B) said housing has a bottom wall and top wall, each having a plurality of radial peripheral slots corresponding in number to the number of side wall panels, (C) each of said side wall panels has an inwardly directed flange extending along each vertical side edge; and (D) the adjacent flanges of adjacent wall panel edges being in abutment and received in snap fit relation in the radial peripheral slots of said bottom and top walls.

8. An air brush organizer according to claim 7 wherein:

(A) the bottom edges of said wall panel flanges are recessed to form a shoulder resting on the top surface of the housing bottom wall, and (B) the top edges of said wall panel flanges are recessed to form shoulders upon which the top housing wall rests.

9. An air brush organizer according to claim 8 wherein said housing wall is composed of three arcuate panels.

10. An air brush organizer according to claim 1 wherein said base is provided with wheels or casters.

11. An air brush organizer according to claim 1 wherein:

(A) an auxiliary horizontal shelf for receiving and holding additional air guns is disposed spaced above the housing top wall, and (B) said auxiliary shelf is supported by a plurality of tubular legs, each overlying an opening in the housing top wall for passage of a length of flexible tubing and extending upward from the top surface of the auxiliary shelf.

12. An air brush organizer according to claim 11 wherein said auxiliary shelf is generally triangular in configuration.

13. An air brush organizer according to claim 11 wherein:

(A) the horizontal cross section of said housing is in the configuration of an elliptical triangle, (B) said housing top wall is of a size to receive and hold at least twelve air guns for application of three primary colors, three secondary colors, and six trinary colors, (C) air guns for applying primary colors are located on the housing top wall at the apices of said elliptical triangle, (D) air guns for applying secondary colors are located on the housing top wall between those for applying primary colors, (E) air guns for applying trinary colors are located on the housing top wall between those for applying corresponding primary and secondary colors, (F) air guns for applying other colors and materials are located on the auxiliary shelf above the housing top wall, (G) a color coding band is applied to the top edge of said housing identifying the primary color locations, and (H) said color coding band includes the secondary and trinary colors adjacent to the location of the air guns for applying those colors.

14. An air brush organizer according to claim 1 wherein:

(A) the horizontal cross section of said housing is in the configuration of an elliptical triangle, (B) air guns for applying primary colors are located on the housing top wall at the apices of said elliptical triangle, and (C) a color coding band is applied to the top edge of said housing identifying the primary color locations.

15. An air brush organizer according to claim 14 wherein:

(A) said housing top wall is of a size to receive and hold at least six air guns for application of three primary colors and three secondary colors, (B) the air guns for applying secondary colors are positioned on the housing top wall between the air guns for applying the colors which when mixed form the secondary color, and (C) said color coding band includes the secondary colors adjacent to the location of the air guns for applying those colors.

16. An air brush organizer according to claim 14 wherein (A) said housing top wall is of a size to receive and hold at least twelve air guns for application of three primary colors, three secondary colors, and six trinary colors, (B) the air guns for applying secondary colors are positioned on the housing top wall between the air guns for applying the colors which when mixed form the secondary color, (C) the air guns for applying trinary colors are positioned on the top wall between the guns for applying the primary and secondary colors which when mixed form the trinary color, and (D) said color coding band includes the secondary and trinary colors adjacent to the location of the air guns for applying those colors.

* * * * *